United States Patent [19]

Berger et al.

[11] 4,153,201

[45] May 8, 1979

[54] TRANSDUCER ASSEMBLY, ULTRASONIC ATOMIZER AND FUEL BURNER

[75] Inventors: Harvey L. Berger, Poughkeepsie; Charles R. Brandow, Highland, both of N.Y.

[73] Assignee: Sono-Tek Corporation, Poughkeepsie, N.Y.

[21] Appl. No.: 739,812

[22] Filed: Nov. 8, 1976

[51] Int. Cl.[2] ..... H04F 17/00

[52] U.S. Cl. ..... 239/102; 239/4; 310/325; 431/1

[58] Field of Search ..... 431/1; 239/4, 102; 310/325

[56] References Cited

U.S. PATENT DOCUMENTS

| | | | |
|---|---|---|---|
| 3,162,368 | 12/1964 | Choate et al. | 239/4 X |
| 3,283,182 | 11/1966 | Jones et al. | 310/325 |
| 3,373,752 | 3/1968 | Inoue | 239/4 X |
| 3,396,285 | 8/1968 | Minchenko | 310/325 |
| 3,689,783 | 9/1972 | Williams | 310/325 |
| 3,891,869 | 6/1975 | Scarpa | 310/325 |

*Primary Examiner*—Edward G. Favors

*Attorney, Agent, or Firm*—Kenyon & Kenyon, Reilly, Carr & Chapin

[57] ABSTRACT

A transducer assembly includes a first half wavelength double-dummy section having a pair of quarter wavelength ultrasonic horns and a driving element sandwiched therebetween. A second half wavelength stepped amplifying section extends from one end of the first section and has a theoretical resonant frequency equal to the actual resonant frequency of the first section. When used as a liquid atomizer, the small diameter portion of the stepped amplifying section has a flanged tip to provide an atomizing surface of increased area. To maintain efficiency, the length of the small diameter portion of the second section with a flange should be less than its length without a flange. A decoupling sleeve within an axial liquid passageway eliminates premature atomization of the liquid before reaching the atomizing surface. In a fuel burner incorporating the atomizer, ignition electrode life is increased by locating the electrodes outside the normal flame envelope. During the ignition phase, drive power to the atomizer is increased to widen the spray envelope to the location of the electrodes. A variable orifice controls combustion air flow in accordance with fuel rate while maintaining constant lower speed. Either three-step or continuous fuel rate modulation saves fuel and reduces pollution.

13 Claims, 18 Drawing Figures

TRANSDUCER ASSEMBLY, ULTRASONIC ATOMIZER AND FUEL BURNER

BACKGROUND OF THE INVENTION (1) Field of the Invention

The present invention relates to transducer assemblies and to apparatus employing same for achieving efficient combustion of fuels. An example of same is found in the U.S. Pat. to H. L. Berger, No. 3,861,852, issued Jan. 21, 1975.

(2) Description of the Prior Art

When designing ultrasonic transducer assemblies such as those employed in apparatus for achieving combustion of fuels, a theoretical model for the ultrasonic horn is used in the developmental stage. The theoretical model is that of a one dimensional transmission line.

In the actual operating environment, however, deviations from the theoretical model are introduced. The deviations are due to, among other things: the finite dimensions of the sections of the horn setting up modes other than longitudinal, e.g. expansion in a transverse direction; clamping means; sealing means; physical mismatch between component parts (planarity); etc.

The introduction of the deviation into the theoretical model normally produces internal losses in the transducer assembly and thus reduces Q, the mechanical merit factor.

The approach used in designing such prior art transducer assemblies so as to achieve maximum Q has been to: treat the entire assembly as a theoretical structure; choose the vibration frequency at which the structure is in resonance; provide an ultrasonic horn, according to a theoretical model whose size is such as to provide the resonance condition; and, utilize materials and associated hardware such as fuel supply means, clamp means, seals, etc., of such type and so positioned as to minimize losses inherent in the deviation from the theoretical model.

The prior art design approaches have failed to achieve maximum Q for a number of reasons: inappropriate design (deviations from the theoretical model); and, poor acoustical coupling between the center electrode and the piezoelectric crystals of the driving element and between the driving element crystals and adjacent ultrasonic horn sections caused either by imperfect machining of the crystals or by the presence of contaminants between the mating surfaces.

A second problem associated with transducer assemblies of the type used in apparatus for achieving combustion of fuels is the non-uniform delivery of fuel to the atomizing surface with consequent non-uniform distribution of fuel from same. It has been discovered that with such prior art assemblies, fuels which have low surface tension as, for example, hydrocarbon fuels, begin to atomize within the fuel passage leading to the atomizing surface. This premature atomization creates bubbles within the fuel passage. The bubbles eventually work their way to the atomizing surface, but their arrival at the atomizing surface results in a temporary interruption in fuel flow to portions of the surface and, as a result, non-uniform distribution of fuel over the surface. The bubble remains intact for a short period of time on the atomizing surface and thus the surface area beneath the bubble during the interval is not wet with fuel.

A third problem associated with transducer assemblies of the type used in apparatus for achieving combustion of fuels is that the fuel, once delivered to the atomizing surface, even if delivered uniformly, is not distributed or atomized from same uniformly. It has been discovered that one of the reasons for non-uniform distribution is the flexing action of the atomizing surface itself, characteristic of the prior art structure.

A fourth problem associated with prior art transducer assemblies is lack of efficiency. Briefly stated, in an ultrasonic fuel atomizer a film of fuel is injected at low pressure onto an atomizing surface and vibrated at frequencies in excess of 20 kHz in a direction perpendicular to the atomizing surface. The rapid motion of the plane surface sets up capillary waves in the liquid film. When the amplitude of wave peaks exceeds that required for stability of the system, the liquid at the peak crests breaks away in the form of droplets.

The smaller the droplet size the greater the fuel-air interface for a given volume of fuel. The increased fuel-air interface allows better utilization of primary combustion air resulting in low-excess air combustion, a desirable feature from an efficiency standpoint.

Going one step further, for a given fixed volume flow rate of fuel reaching the atomizing surface, the thinner the film, the more surface area will be involved in the atomizing process. This allows for greater atomizing capacity. It has been discovered that prior art transducer assemblies have been limited in this respect, however, due to the fact that the fuel fed to the atomizing surface does not cover the entire surface before atomization occurs. Additionally the surface tension associated with smooth metallic atomizing surfaces give rise to a tendency for not wetting the entire surface.

SUMMARY OF THE INVENTION

An object of the invention is the provision of an improved, reliable, high power, high Q transducer assembly of the type used in apparatus for achieving efficient combustion of fuels.

Another object is an improved method for designing such assemblies.

Still another object is the elimination of premature atomization of fuel in the fuel passage leading to the atomizing surface of an ultrasonic fuel atomizer.

A further object is uniform atomization of fuel from the entire atomizing surface of an ultrasonic fuel atomizer.

A still further object is uniform distribution of fuel over the entire atomizing surface in a thin film.

Another object is an improved fuel burner with increased ignition electrode lifetime.

Still another object is air flow control means within the fuel burner.

BRIEF DESCRIPTION OF THE DRAWING

The foregoing and other objects, features and advantages of the invention will be apparent from the following more particular description of the preferred embodiment of the invention, as illustrated in the accompanying drawing, wherein.

DESCRIPTION OF THE PREFERRED EMBODIMENTS

Figure 1:
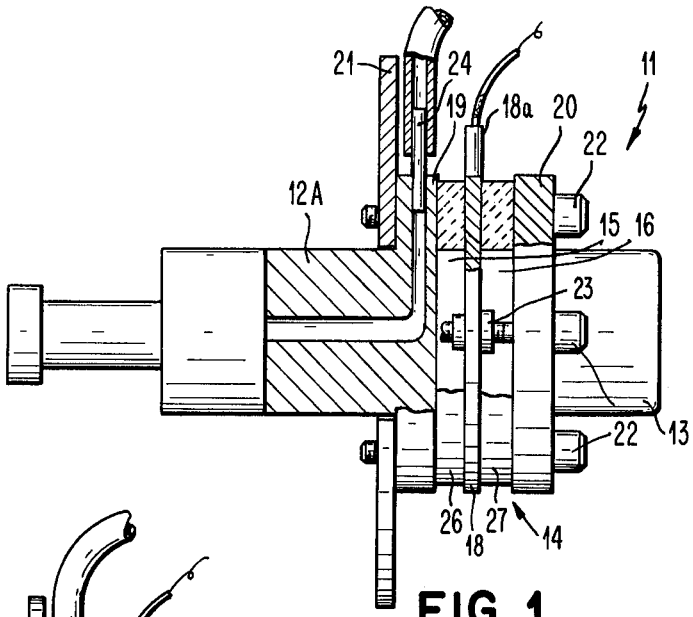
FIG. 1 is a view of a first transducer assembly of the present invention showing a first section of the assembly in partial cross section.
Figure 2:
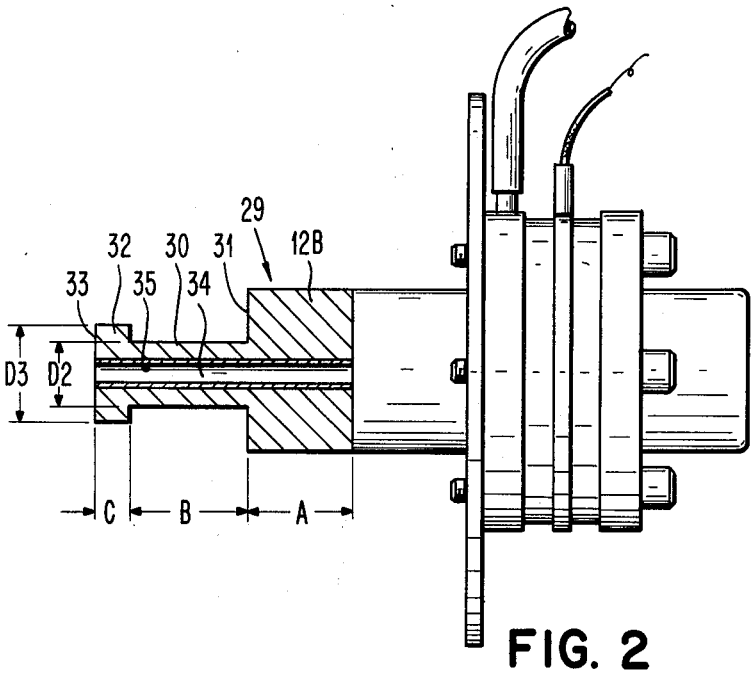
FIG. 2 is a view of a transducer assembly of the present invention showing a second section of the assembly in cross section.
Figure 3:
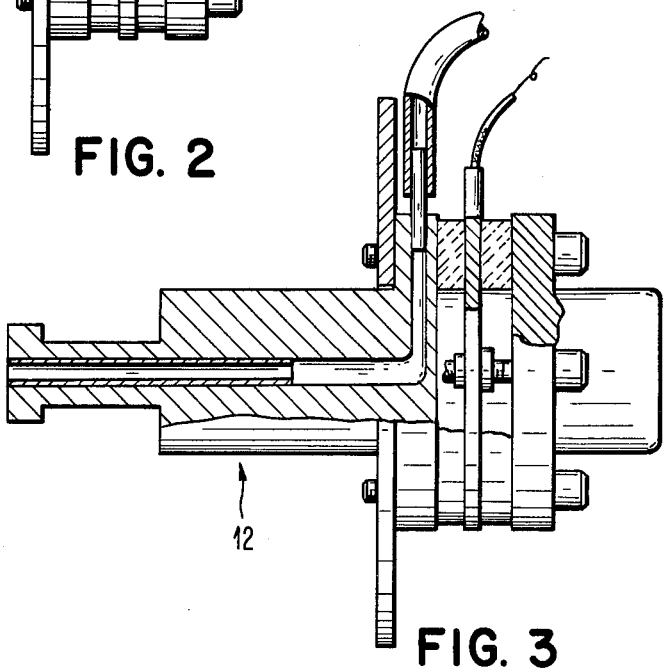
FIG. 3 is a partial cross sectional view of a complete transducer assembly of the present invention.

Referring to FIGS. 1-3, in accordance with one aspect of the invention the design of a transducer assembly is optimized, for, among other things, maximum Q, by designing for a predetermined theoretical natural frequency a first half wavelength transducer assembly section comprising a driving element and two identical horn sections (FIG. 1) such that the resulting structure forms a symmetric geometry with respect to the longitudinal axis. This first assembly section is referred to as a double-dummy ultrasonic horn. In the next operation step, an actual double-dummy horn is constructed according to the design of the first assembly section, and the resonant frequency of the first section is measured A second half wavelength section (FIG. 2) that includes an amplification step and an atomizing surface is next designed to have a theoretical resonant frequency that matches the empirically measured resonant frequency of the actual first section. A liquid atomizing transducer assembly that combines the first and second sections is then constructed (FIG. 3), the final transducer assembly being designed for maximum Q and for achieving efficient combustion of fuels.

Referring first to FIG. 1 the first section 11 of the novel transducer assembly is seen as including front 12A and rear 13 ultrasonic horn sections and a driving element 14 comprising a pair of piezoelectric discs 15, 16 and an electrode 18 positioned therebetween, excited by high frequency electrical energy fed thereto through a terminal 18*a*.

Driving element 14 is sandwiched between flanged portions 19, 20 of horn sections 12A, 13 and securely clamped therein by means of a clamping assembly that includes a mounting ring 21 (for securing the assembly to other apparatus) and a plurality of assembly bolts 22 which pass through holes in electrode 18, flange sections 19 and 20, and into threaded openings in mounting ring 21. The assembly bolts 22 are electrically isolated from the electrode 18 by means of insulators 23.

The first section 11 further includes a fuel tube 24 for introducing fuel into a channel within the transducer assembly and a pair of sealing gaskets 26, 27 compressed between horn flange sections 19, 20.

In a typical embodiment: the horn sections 12A, 13 and flange sections 19, 20 are preferably of good acoustic conducting material such as aluminum, titanium or magnesium; or alloys thereof such as Ti—6Al—4V titanium-aluminum alloy, 6061-T6 aluminum alloy, 7075 high strength aluminum alloy, AZ 61 magnesium alloy and the like; the discs 15, 16 are of lead-zirconate-titanate such as those manufactured by Vernitron Corporation or of lithium niobate such as those manufactured by Valtec Corporation; the electrode 18 is of copper; the terminal 18*a*, mounting ring 21, and assembly bolts 22 are of steel; the insulators 23 are of nylon, tetrafluoroethylene or some other plastic with good electrical insulating properties; and, the sealing gaskets 26, 27 are of silicone rubber.

The double-dummy design of the first section 11 has symmetric half-wavelength geometry, yet the actual first section assembly contains anomalous features, i.e. clamping at non-nodal planes, copper electrode, clamping bolts and mounting bracket, that will cause the actual resonant frequency of this section to deviate from the theoretical design frequency. The characteristic frequency, for maximum Q, of this first section is measured. A typical frequency for effective atomization is 85KHZ. This completes the first step in the design of the transducer assembly.

Referring to FIG. 2, another half-wave section 29 is added to the first section 11. The section 29 includes a large diameter segment 12B, a small diameter segment 30 so as to form an amplification step 31, a flanged tip 32 with atomizing surface 33, a central passage 34 for delivering fuel to the atomizing surface 33 and an internally mounted decoupling sleeve 35. The decoupling sleeve is a substance such as tetrafluoroethylene which provides acoustic isolation from the surface of passage 34.

It will be observed by those skilled in the art that section 29 contains few anomalies compared with a purely theoretical model. Its theoretical resonant frequency is selected to match the actual resonant frequency of the first section 11.

In order to complete the design, the two sections 11 and 29 are formed integrally so as to yield a transducer assembly (FIG. 3) optimized for maximum Q and for use in achieving efficient combustion of fuels.

Prior art transducer assemblies used for ultrasonic atomization of fuel have typically employed a flanged tip 32 with atomization surface 33. The flanged tip increases atomization capabilities due to increased area of atomizing surface 33.

The addition of such flange has been at the expense of atomizer efficiency.

Referring to FIG. 2, let A=length of horn front section 12B, B=length of small diameter segment 30 and C=thickness of flanged tip section 32.

In prior art assemblies that do not use a flange, A/B=1 since they are both quarter wavelength sections.

In prior art assemblies utilizing a flange A/B+C=1.

It has been determined that maintaining the ratio at 1, even after addition of the flange, is inefficient and reduces power transfer, but by maintaining the ratio A/B+C>1 efficiency levels can be maintained at pre-flange addition levels. Thus, for example, if $D_3$=diameter of flange section 32

$D_2$=diameter of small diameter segment 30 for $D_3/D_2=1.53$

A/B+C (without flange)=A/B=1 and A/B+C (with flange)=1.12 and the efficiency levels achieved with the flange match those of the assembly without the flange.

The foregoing example applies to assemblies of aluminum, titanium, magnesium and previously mentioned alloys, and assumes that for all these materials the velocity of sound is approximately the same. For other materials with different velocities of sound the ratio A/B+C will differ but always will be greater than 1.

The long-term reliability of the device is dramatically enhanced by sealing the discs 15 since fuel contamination is no longer possible. The space between the clamping flange sections 19, 20 is filled with a silicone rubber compound as by sealing gaskets 26, 27. In the past, fuel creepage onto the faces of the discs 15, 16 has caused degradation of same and has resulted in poor long-term atomizer performance. The phenomenon causes a loss in mechanical coupling between elements of the horn. The gaskets 26, 27 solve the problem and atomizer performance is not affected by the added mass as has been confirmed by before and after measurement of impedance, operating frequency and flange displacement. The slightly higher internal heating caused by sealing the discs 15 does not reduce the atomizer's useful life since internal temperatures are still well below the maximum operating temperature for piezoelectric crystals. The gaskets 26, 27 are of a compressible material and have an inner periphery conforming to but initially slightly greater than the outer circumference of the discs 15, 16. Upon clamping, the inner periphery of gaskets 26, 27 come into light contact with the outer circumference of the discs 15, 16.

Another aspect of the present invention is the elimination of premature atomization of fuel in the fuel passage leading to the atomizing surface. As noted previously, in prior art structures the fuel can begin to atomize within the fuel passage leading to the atomizing surface. This premature atomization creates voids within the fuel passage at the fuel-wall interface which leads to the formation of bubbles within the fuel passage. The bubbles eventually work their way to the atomizing surface, but their arrival at the atomizing surface results in a temporary interruption in fuel flow to a portion of the surface and as a result, non-uniform distribution of fuel over the surface. The bubble remains intact for a short period of time on the atomizing surface and thus the surface area beneath the bubble during that interval is not wet with fuel. The net effect of this non-uniform and constantly varying distribution of fuel on the surface is a spatially unstable spray of fuel, a condition which leads to unstable combustion.

The foregoing problem is eliminated by the provision of a decoupling sleeve 35 within the fuel passage 34 that extends up to, say within 1/32 of an inch of the atomizing surface 33. The sleeve is typically made of plastic and press fit into passage 34 extending inwardly to large diameter segment 12B. The difference in acoustical transmitting properties between the material of the sleeve 35 and the horn section 29 is such that the vibrating motion of section 29 is not imparted to the fuel within the fuel passage 34 encompassed by the sleeve 35.

Still another object of the present invention is achieving uniform atomization from the atomizing surface of an ultrasonic fuel atomizer.

It has been discovered that the non-uniform distribution or atomization is due in part to the fact that the atomizer tip flexes during vibration and that the non-uniform distribution is decreased when the flange face or atomizing surface 33 moves as a rigid plane. The atomizing surface will move as a rigid plane by increasing the thickness of the flanged tip 32 such that the tip 32 and surface 33 remain rigid during vibration. In a typical embodiment tip 32 is 0.050" thick.

A further aspect of the present invention is achieving greater atomizing capacity. As noted above, it has been discovered that prior art transducer assemblies have been limited in this respect due to the fact that the fuel fed to the atomizing surface does not cover the entire surface before atomization occurs. Additionally the surface tension normally associated with smooth metallic atomizing surfaces gives rise to a tendency for not wetting the entire surface.

The aforementioned prior art difficulties are overcome in accordance with the teachings of the present invention by reducing surface tension at the fuel-atomizing surface interface thereby permitting the fuel when fed to the atomizing surface to flow more readily over the atomizing surface and by the provision of means for more evenly distributing fuel over the atomizing surface.

Figure 4:
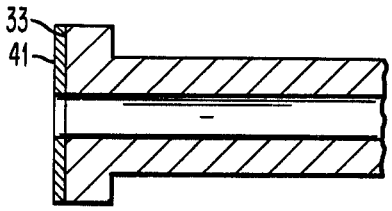
FIG. 4 is an enlarged cross sectional view of an alternate embodiment of a flanged atomizing tip with coated atomizing surface.

In accordance with one embodiment and referring to FIG. 4, surface tension at the fuel-atomizing surface is reduced by coating the atomizing surface with a substance that reduces surface tension. FIG. 4 depicts the flanged tip 32 as having an atomizing surface 33 with a thin coating 41 thereon. Examples of such materials are tetrafluoroethylene, polyvinyl chloride, polyesters and polycarbonates.

Figure 5:
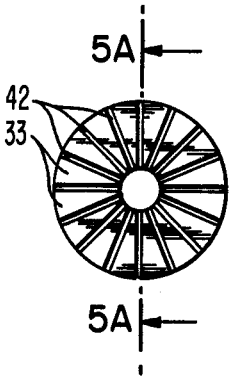
FIG. 5 is an enlarged front view of an alternate embodiment of a flanged atomizing surface showing the atomizing surface with fuel channels.
Figure 5A:
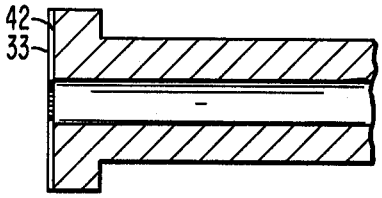
FIG. 5A is a sectional view taken along the lines 5A—5A of FIG. 5.

In accordance with another embodiment and referring to FIG. 5, the ability of fuel to reach the outer edges is increased by the provision of preferred paths or channels 42 in the atomizing surface 33. The inclusion of channels in the atomizing surface which extend to the periphery of the flanged tip promotes flow of fuel over the entire atomizing surface. Thus for a given quantity of fuel, the result is a thin film over substantially the entire atomizing surface instead of a somewhat thicker film centered about the central fuel passage.

Figure 6:
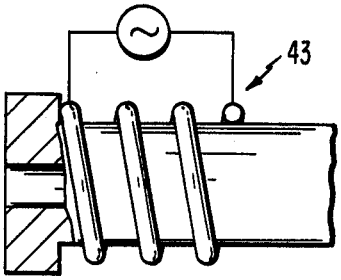
FIG. 6 is an enlarged partial sectional view of an alternate embodiment of a flanged atomizing tip with heating means for the atomizing tip.

In accordance with another embodiment and with reference to FIG. 6 heating means 43 are provided to heat the atomizing surface during operation to temperatures on the order of up to 150° F. The heat reduces the viscosity of the fuel and promotes easier wetting of the surface.

Figure 7:
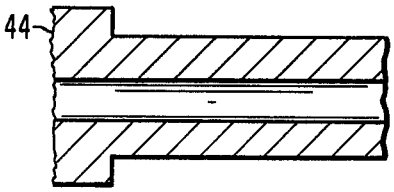
FIG. 7 is an enlarged sectional view of an alternate embodiment of a flanged atomizing surface showing the atomizing surface etched to increase surface area.

In accordance with another embodiment and with reference to FIG. 7, the atomizing surface is etched as at 44, by sand-blasting, thereby greatly increasing surface area and reducing film thickness for a given quantity of fuel.

Figure 8:
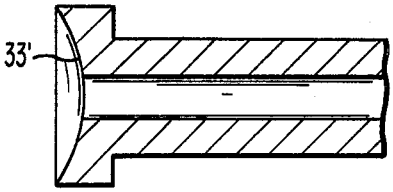
FIG. 8 is an enlarged sectional view of an alternate embodiment of a flanged atomizing tip with convex atomizing surface.
Figure 9:
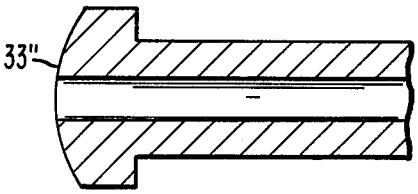
FIG. 9 is an enlarged sectional view of an alternate embodiment of a flanged atomizing tip with a concave atomizing surface.

The geometrical contour of the flanged atomizing surface influences the spray pattern and density of particles developed by atomization. Thus, for example, a planar face atomizing surface 33 such as depicted in FIGS. 2–7 will generate a particular pattern and density. If the surface is made to be convex, as shown at 33' in FIG. 8, the spray pattern is wider and there are fewer particles per unit of cross-sectional area than with a planar surface. A concave surface 33" such as that depicted in FIG. 9 narrows the spray pattern and density of particles is greater than with a planar surface. Different spray patterns may be required depending on the application.

Turning attention now from the transducer assembly per se to a fuel burner, a recurring problem is the short life of the ignition electrodes. These electrodes provide the spark for initiating the ignition of the fuel/air mixture within the flame cone. Once ignition occurs, however, the electrodes extend into the flame envelope resulting from ignition and this constant exposure to high intensity heat during the firing cycles leads to rapid deterioration of the electrodes and frequent replacement of same.

In accordance with another aspect of the present invention, the aforementioned prior art difficulty has been greatly diminished by locating the ignition electrodes outside the normal flame envelope, but increasing the drive power to the atomizer electrodes during the ignition phase. This has the effect of increasing the angle of the spray envelope considerably, bringing the ignition electrodes within the space occupied by the fuel/air mixture and resulting flame envelope. As soon as ignition is accomplished the angle of the spray envelope is returned to its normal running mode by decreasing drive power to the atomizer electrodes such that the ignition electrodes are located outside the normal flame envelope.

Figure 10:
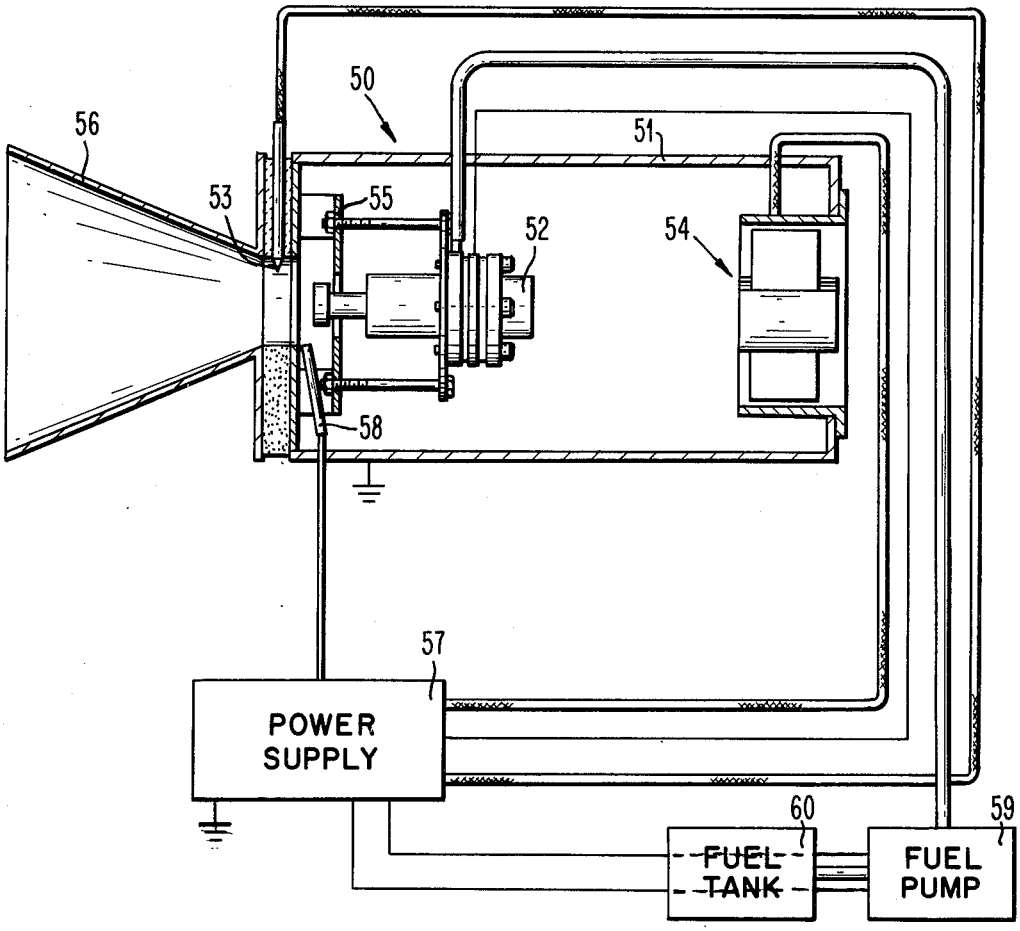
FIG. 10 is a view partly in cross-section and partly in schematic of a fuel burner constructed in accordance with the teachings of the present invention for increasing the life of the ignition electrodes.
Figure 10A:
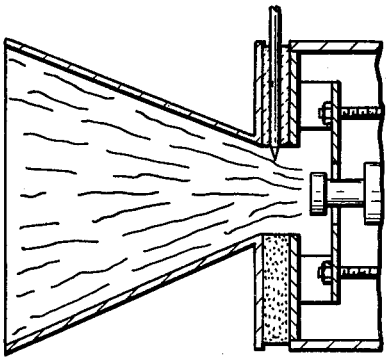
FIG. 10A is a sectional view of the forward end of a fuel burner with the ignition electrodes located within the flame envelope momentarily during the ignition phase.
Figure 10B:
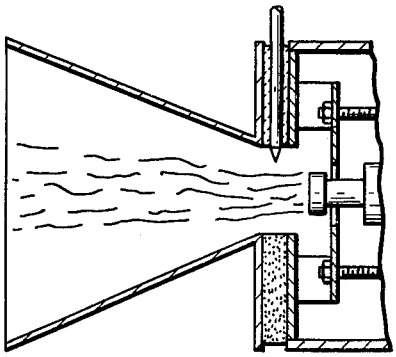
FIG. 10B is a sectional view similar to FIG. 10A showing the ignition electrodes outside the flame envelope during the normal operating cycle.

Referring now to FIG. 10, the fuel burner 50 is seen as including blast tube 51, a transducer assembly 52, ignition means including ignition electrodes 53, blower 54 for supplying air for combustion and for cooling the transducer assembly 52, air deflection means 55, flame cone 56, variable means 57 for supplying electric power, flame sensor 58, and pump means 59 for supplying fuel from a fuel tank 60 to the transducer assembly. The ignition electrodes 53 are located between blast tube 51 and flame cone 56 and held by ceramic or porcelain insulators surrounded by high temperature asbestos material and near the atomizing surface but at a sufficient distance, typically ½ inch, to prevent arcing of the ignition spark to the atomizer structure. During the ignition phase additional electrical power is supplied by the power supply 57 to the input leads of the transducer assembly (greater voltage and current than during normal operation). Optionally, this can be accomplished automatically by programming the power supply electronics such that prior to ignition the circuit supplies an excessive amount of power to the input leads of the transducer assembly apparatus. During the ignition phase the ignition electrodes are located within the flame envelope generated within the flame cone (FIG. 10A). Once ignition has been established the flame sensor 58 sends a signal back to the power supply electronics switching the atomizer drive power to its normal operating mode, reducing the envelope of the flame and thus the ignition electrodes 53 found to be located outside the normal flame envelope (FIG. 10B). This promotes longer ignition electrode life by virtue of the electrodes being kept at a cooler temperature during the normal operating cycle. The ignition electrodes will not foul nor will they be oxidized by continuous heating.

Figure 11:
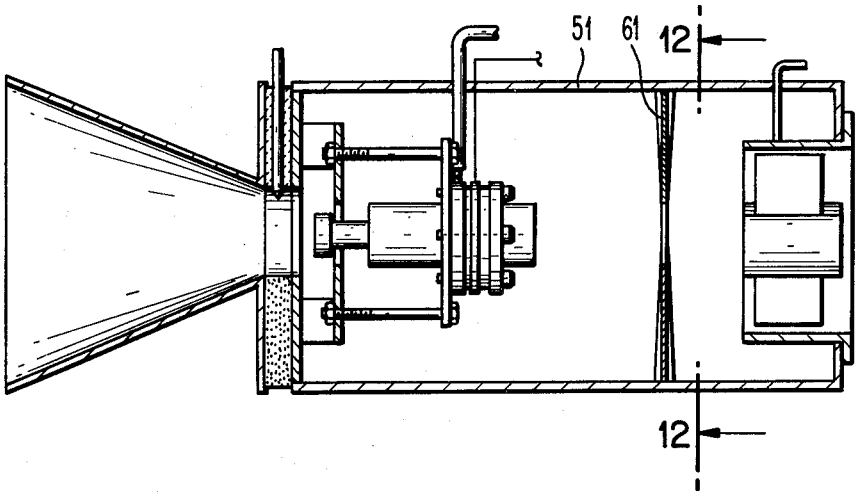
FIG. 11 is a view partly in cross-section and partly in schematic of a fuel burner constructed in accordance with the teachings of the present invention, including means for varying the flow rate of air through the burner.
Figure 12:
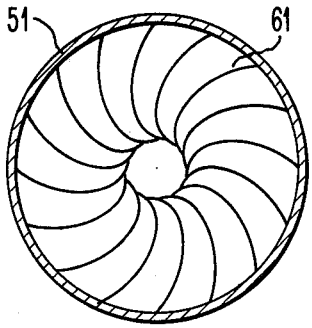
FIG. 12 is a sectional view taken along the lines 12—12 of FIG. 11.
Figure 13:
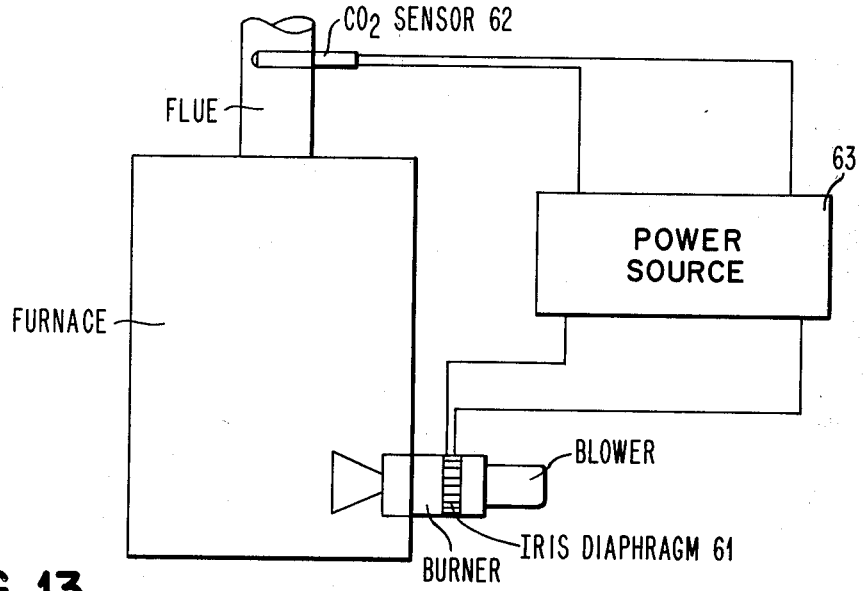
FIG. 13 is a block diagram illustrating a control system for air flow rate varying means shown in FIGS. 11 and 12.

An advantage to the use of an ultrasonic fuel atomizer is that one can vary the flow rate of fuel over a wide range. However, in order to implement a variable flow rate burner it is advantageous to have means to change the flow rate of combustion air through the burner combustion tube 51. This can be done either by electrically controlling the blower motor speed or by providing a variable sized orifice for air flow located in the air stream while maintaining a constant motor speed. With reference to FIGS. 11–13 the latter method is preferred because only by this means can the static pressure head of air within the burner be maintained in order to develop turbulence necessary for proper combustion. This is implemented by an iris-type diaphragm 61 located within the combustion tube (FIGS. 11 and 12) that is controlled electrically as shown in FIG. 13.

The control of the iris diaphragm 61 is done electrically. For each fuel flow rate the amount of air is automatically adjusted by opening or closing the diaphragm until optimum burning conditions are sensed. The optimum burning conditions are sensed by monitoring the $CO_2$ level in the flue gas as at 62 from the furnace and feeding back data from that sensor to air control circuitry 63 for iris diaphragm 61 until a predetermined $CO_2$ level, say 12.5–13% $CO_2$, is achieved.

In the prior art an oil burner will operate in a two stage mode, "off" and "on" and at a fixed fuel flow rate. It has been determined that such two stage operation suffers from a number of disadvantages. Firstly, it is uneconomical in the sense that it consumes more fuel than is necessary and, secondly, it contributes to pollution. In the two stage operation when the system is turned from the off position to the on position or vice-versa, the firing is accompanied by generation of high volumes of unburned hydrocarbons and carbon monoxide.

It has been determined that the aforementioned prior art difficulties may be eliminated and in accordance with the teachings of the present invention by going to a "three stage" modulated mode of operation.

Figure 14:
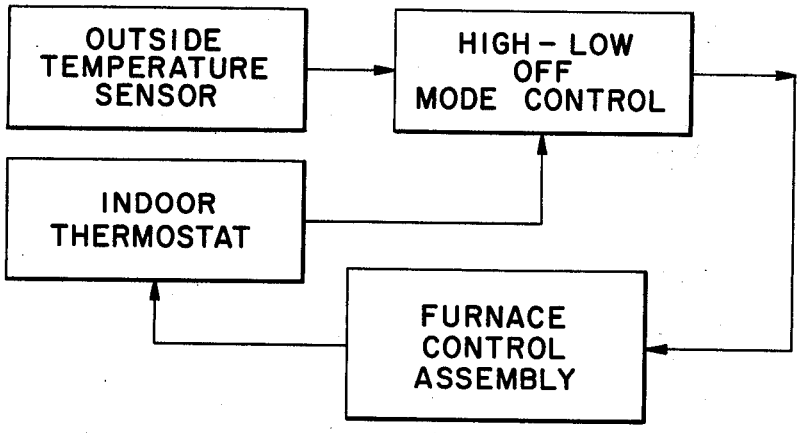
FIG. 14 is a block diagram of a three stage modulated mode of operation of an oil burner furnace utilizing an ultrasonic transducer assembly; and, FIG. 15 is a block diagram of a solar panel supplementary heating system employing continous modulation.

The three stage mode, and with reference to FIG. 14, refers to a system in which there are three different firing rates—high, low and off. For example, the three rates could typically be High—0.60 gal./hr.
Low—0.20 gal./hr.
Off—0.00 gal./hr.

The high rate is called for by a duct or stack thermostat 71 in response to sensing a heat deficiency, just as is done in conventional heating systems with conventional thermostats. When the heat demand has been satisfied (as determined by the thermostat setting) the system returns to the "low" firing rate via control valve 72 to furnace control assembly 73 in order to maintain system ductwork and heat exchanger at an elevated temperature and to eliminate the draft losses occurring if the system were turned off completely as is the case in conventional heating systems.

The operating cycle is between a high flow rate and a low flow rate, for example, 10 minutes at high firing rate, then 20 minutes at low, then 10 minutes more at high, etc. The time at high and low firing rates will vary with demand for heat. This cycle allows for more efficient utilization of the furnace since the system is already warm when the high part of the heating cycle begins. Moreover, the firing rate for the high mode need not be as great as needed for a conventional cycle since the modulated system will respond to the heat demand more quickly given the already warm conditions created during the low period.

The off part of the three stage system would be used only during times of zero heat demand such as on days when outside temperatures equal or exceed the inside temperatures. This condition could be sensed by an external temperature sensor 74 fed into the system or could be manually controlled by the user.

In accordance with another aspect of the present invention, the transducer assembly of the present invention can be used in an oil burner furnace system that employs continuous modulation.

Figure 15:
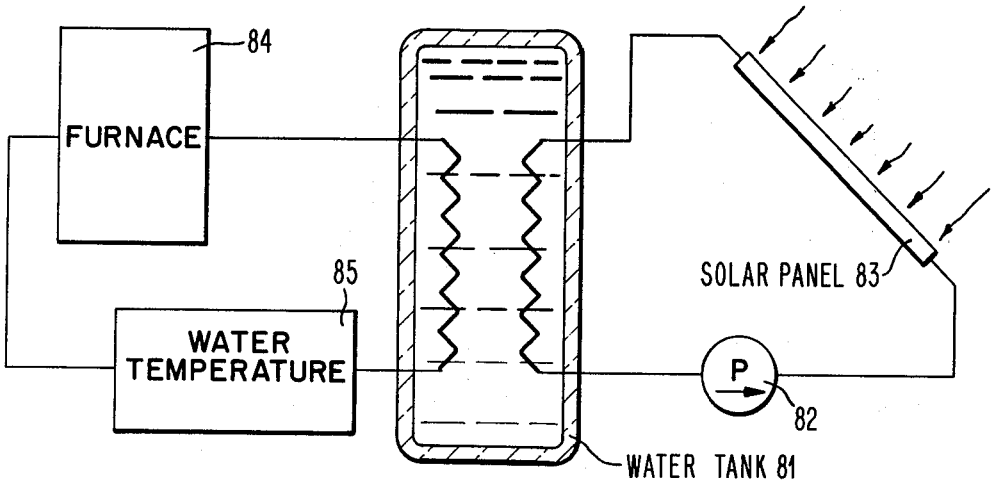

With reference to FIG. 15 the firing rate of a system is allowed to vary continuously between some fixed upper and lower limits in response to an external control signal supplied to the burner electronics as, for example, in the solar panel supplementary heating system depicted. When the temperature of the hot water tank 81 is to be maintained above a minimum temperature $T_0$, the variable nature of the solar derived energy via pump 82 and solar panel 83 requires that any solar energy deficit be made up by the appropriate flux of heat from the oil burner assembly 84. This deficit, being variable, is sensed as at 85 and demands that the oil burner 84 be able to fire at any possible rate within the design limits of the system such that the sum of the solar and oil burning heat delivered remains fixed at the required level.

It should be obvious to those skilled in the art that while my invention has been illustrated for use in a burner suitable for burning fuel oil for heating a home it may be used elsewhere to great advantage. It may be used, for example, in a burner for a mobil home where its low flow rate, typically less than one-half gallon per hour, and variable flow feature have obvious economic advantage. The invention may also be used for feeding fuel into internal combustion or jet engines. The invention may also be used for atomization of other liquids such as water. While the invention has been particularly shown and described with reference to the preferred embodiments thereof, it will be understood by those skilled in the art that various changes in form and detail and omission may be made without departing from the spirit and scope of the invention.

What is claimed is:

1. A transducer assembly comprising:

a first section in the form of a symmetrical double-dummy ultrasonic horn having a driving element sandwiched therein, said first section having an empirically measured characteristic resonant frequency and a second section including an amplification step, wherein the theoretical resonant frequency of the second section matches the empirically measured frequency of the first section.

2. An ultrasonic transducer including a first driver section and a second half-wavelength output section having a large diameter segment of length A extending from the driver section, a small diameter segment of length B extending from said large diameter segment, and a displacement antinode at the free end of the small diameter section comprising a flanged tip of thickness C, the improvement wherein $A/B+C>1$.

3. An ultrasonic transducer according to claim 2 wherein said flanged tip comprises an atomizing surface, said flange being of sufficient thickness to move as a rigid plane during vibration of the transducer.

4. An ultrasonic transducer assembly including a front ultrasonic horn section, a rear ultrasonic horn section, a driving element having at least one piezoelectric disc sandwiched between the front and rear ultrasonic horn sections, means for clamping the front and rear ultrasonic horn sections against the driving element, and an output section extending from the front ultrasonic horn section and terminating in an atomizing surface, wherein the improvement comprises:

annular sealing means of compressible elastomeric material surrounding the at least one piezoelectric disc between the front and rear ultrasonic horn sections, said sealing means having an inner periphery which, in the unstressed condition, conforms to the shape of but is slightly greater than the periphery of the piezoelectric disc, and the compression exerted by the clamping means being sufficient to provide good acoustic coupling between the driving element and the front and rear ultrasonic horn sections when the inner periphery of the sealing means lightly contacts the outer periphery of the piezoelectric disc.

5. A transducer assembly comprising:

a first section including a rear ultrasonic horn having a flanged portion at one end thereof, a front ultrasonic horn having a flanged portion at one end thereof, a driving element comprising a pair of piezoelectric discs and an electrode positioned therebetween, said driving element being positioned between the flanged portions of said front and rear horns, and means for clamping the flanged portions of said front and rear horns in compression against said driving element, said first section having an empirically measured characteristic resonant frequency; and a second section including a large diameter portion of length A integrally formed with the front horn of said first section, a small diameter portion of length B extending from said large diameter portion, the interface between said large diameter and small diameter portions constituting a step for amplifying vibratory motion at said atomizing surface, said second section having a theoretical resonant frequency matching the empirical resonant frequency of said first section.

6. An ultrasonic transducer according to claim 5 comprising a rigid flanged tip of thickness C on the forward end of said small diameter portion, said tip having an atomizing surface, wherein the second section is a half wavelength section and $A>B+C$.

7. An ultrasonic transducer according to claim 5 wherein the second section has a flanged tip comprising a vibrating surface capable of causing atomization in a liquid, and the transducer further comprises means for delivering liquid to said atomizing surface, said liquid delivery means including a passage extending through said second section to said atomizing surface and a decoupling sleeve mounted within said passage and extending to said atomizing surface for acoustically isolating the interior surface of said passage from liquid flowing therethrough.

8. A transducer assembly according to claim 5 wherein the means for clamping the flanged portions of said front and rear horns in compression against the driving element comprises a plurality of assembly bolts inserted in spaced relation through corresponding holes in the flanged portions of the front and rear horns.

9. A transducer assembly according to claim 8 further comprising:

annular sealing means of compressible elastomeric material surrounding the piezoelectric discs between the flanges of the front and rear horns for preveinting liquid from contacting the piezoelectric discs, said sealing means having an inner diameter which, in the unstressed condition, is larger than the outer diameter of each piezoelectric disc, such that predetermined compression exerted by the assembly bolts sufficient to provide good acoustic coupling between the driving element and the front and rear horns causes the inner circumference of the sealing means to lightly contact the outer circumference of each piezoelectric disc.

10. A transducer assembly according to claim 8 further comprising a mounting ring having a plurality of threaded holes aligned with the assembly bolt holes in the flanged portions of the front and rear horns, the mounting ring being clamped to the front face of the flanged portion of the front horn by engagement of the assembly bolts in the respective threaded holes.

11. A transducer assembly according to claim 8 wherein the first and second sections are half wavelength sections.

12. A method of making a high efficiency piezoelectric ultrasonic transducer comprising the steps of constructing a first transducer assembly section in the form of a double-dummy ultrasonic horn comprising a driving element, two identical front and rear horn sections, and means for clamping the horn sections to the driving element;

empirically measuring the resonant frequency of said first assembly section; and constructing a high efficiency ultrasonic transducer comprising a first section identical to the first transducer assembly section and a second section added to the front horn section of the first transducer assembly section, the second section including an amplification step and having a theoretical resonant frequency equal to the empirically measured frequency of the first transducer assembly section.

13. The method of claim 11 wherein the second section is constructed integrally with the front horn section.

* * * * *

UNITED STATES PATENT AND TRADEMARK OFFICE

CERTIFICATE OF CORRECTION

PATENT NO. : 4,153,201

DATED : 8 May 1979

INVENTOR(S) : Harvey L. Berger and Charles R. Brandow

It is certified that error appears in the above—identified patent and that said Letters Patent is hereby corrected as shown below:

Column 3, line 60: "operation" should be deleted.

Column 3, line 63: after "measured" there should be a period.

Column 11, line 17: "preveinting" should be --preventing--.

Column 12, line 26: "claim 11" should be --claim 12--.

Signed and Sealed this

Fourteenth Day of September 1982

[SEAL]

Attest:

GERALD J. MOSSINGHOFF

Attesting Officer

Commissioner of Patents and Trademarks